US006713957B2

(12) United States Patent
Kanzaki et al.

(10) Patent No.: US 6,713,957 B2
(45) Date of Patent: Mar. 30, 2004

(54) SUPER-HIGH PRESSURE DISCHARGE LAMP OF THE SHORT ARC TYPE

(75) Inventors: Yoshitaka Kanzaki, Himeji (JP); Toyohiko Kumada, Himeji (JP); Masanobu Komiya, Himeji (JP); Koji Miyauti, Himeji (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 4 days.

(21) Appl. No.: 10/241,644

(22) Filed: Sep. 12, 2002

(65) Prior Publication Data

US 2003/0048076 A1 Mar. 13, 2003

(30) Foreign Application Priority Data

Sep. 13, 2001 (JP) ..... 2001-277917
Sep. 17, 2001 (JP) ..... 2001-280926

(51) Int. Cl.[7] ..... H01J 17/20

(52) U.S. Cl. ..... 313/571; 313/332; 313/333; 313/335; 313/574

(58) Field of Search ..... 313/571, 332, 313/333, 335, 574, 623, 626, 631, 632

(56) References Cited

U.S. PATENT DOCUMENTS 4,806,816 A * 2/1989 de Vrijer ..... 313/331
5,107,177 A * 4/1992 Barthelmes et al. ..... 313/623
5,109,181 A 4/1992 Fischer et al.
5,497,049 A 3/1996 Fischer
6,075,314 A * 6/2000 Huettinger et al. ..... 313/332
6,265,817 B1 * 7/2001 Steinmann et al. ..... 313/332
2002/0031975 A1 3/2002 Kanzaki et al.

FOREIGN PATENT DOCUMENTS

JP 03-201357 9/1991
JP 10-289690 10/1998

* cited by examiner

*Primary Examiner*—Ashok Patel
(74) *Attorney, Agent, or Firm*—Nixon Peabody LLP; David S. Safran

(57) ABSTRACT

A super-high pressure discharge lamp of the short arc type which has an arc tube portion in which there is a pair of opposed electrodes and which is filled with at least 0.15 mg/mm$^3$ mercury, and side tube portions which extend from opposite sides of the arc tube portion and in which there are metal foils. The electrodes are each electrically connected to a respective one of the metal foils by a metallic component with cross-sectional area that is smaller than the cross sectional area of the electrodes in the area in which the electrodes are located in the side tube portions.

19 Claims, 5 Drawing Sheets

SUPER-HIGH PRESSURE DISCHARGE LAMP OF THE SHORT ARC TYPE

BACKGROUND OF THE INVENTION

1. Field of the Invention

The invention relates to a super-high pressure discharge lamp of the short arc type in which the mercury vapor pressure during operation is at least 15 MPa. The invention relates especially to a super-high pressure discharge lamp of the short arc type which is used as the backlight of a liquid crystal display device, a projection device such as a DLP (digital light processor), or the like, in which a DMD (digital mirror device) is used.

2. Description of Related Art

In a projector device of the projection type, there is a demand for illumination of the images uniformly onto a rectangular screen with sufficient color reproduction. The light source is thus a metal halide lamp which is filled with mercury and a metal halide. Furthermore, recently smaller and smaller metal halide lamps, and more and more often spot light sources, have been produced and lamps with extremely small distances between the electrodes have been used in practice.

Against this background, instead of metal halide lamps, lamps with an extremely high mercury vapor pressure, for example, with 15 MPa, have recently been proposed. Here, the increased mercury vapor pressure suppresses broadening of the arc (the arc is compressed) and a major increase of the light intensity is desired.

One such super-high pressure discharge lamp is disclosed, for example, in Japanese patent disclosure document HEI 2-148561 (corresponding to U.S. Pat. No. 5,109,181) and Japanese patent disclosure document HEI 6-52830 (corresponding to U.S. Pat. No. 5,497,049).

In such a super-high pressure discharge lamp, the pressure in the arc tube during operation is extremely high. In the side tube portions which extend from opposite sides of the arc tube portion, it is therefore necessary to arrange the silica glass comprising these side tube portions, the electrodes and the metal foils for supply in a sufficient amount, and moreover, almost directly tightly adjoining one another.

Especially since electrodes are generally cylindrical and metal foils are plate-shaped, when the two are joined to one another, in the areas bordering the silica glass, extremely small gaps always form via which high gas pressure in the emission space is applied into the vicinities of the electrode rods; this can lead to the formation and growth of cracks.

Therefore, to prevent crack formation, it becomes a more and more important task how to make this gap smaller. The attempt is made to make smaller the extremely small gap which forms in the vicinity of the electrode rods by reducing the cross sectional area of the electrode rods.

One such gap which is formed in the vicinity of the electrode rods is described, for example, in Japanese patent disclosure document HEI 3-201357.

On the other hand, a super-high pressure discharge lamp of the short arc type which is used in a projector device is subject to extremely severe thermal conditions, the internal air pressure during operation is at least 15 MPa and the value of the wall load is at least 0.8 W/mm$^2$, even if the inner volume of the arc tube is extremely small, e.g., is roughly 80 mm$^3$. Therefore, during operation of the discharge lamp, a heat dissipation measure for preventing a temperature increase of the discharge vessel must be taken to an adequate degree to prevent devitrification.

As this heat dissipation measure, it can be imagined that cooling air or the like can be blown in from outside the discharge vessel. However, as another measure, heat dissipation by heat transfer of the electrodes (electrode rods) is an important element.

If only heat conduction and radiation within the discharge space is mentioned, the heat dissipation effect is better, the thicker the electrode rods (the larger the cross sectional area).

A summary of the aforementioned is described below.

In a super-high pressure mercury lamp of the short arc type for a projector, with extremely severe thermal conditions where the gas air pressure during operation within the discharge vessel is extremely high (for example, at least 15 MPa), the internal volume of the arc tube is at most 80 mm$^3$, and that the wall load is at least 0.8 W/mm$^2$, there are, first of all cases, in which, due to the high filler gas pressure during operation in the side tube portions, cracks form and grow which never form in a normal discharge lamp (with a gas pressure during operation of roughly a few atm to a few dozen atm). It is therefore desirable to reduce the size of the extremely small space which causes the formation of cracks by reducing the diameter of the electrode rod.

Secondly, the high temperature within the discharge space must be quickly subjected to heat dissipation since the thermal conditions during operation are extremely strict. Therefore, it is important to use the action of heat transfer by the electrode rods. As a specific arrangement it is desirable to make the electrode rods thick.

One means for achieving these objects is disclosed, for example, in Japanese patent disclosure document HEI 10-289690. In this patent disclosure document it is disclosed that the diameter of the electrode rod of the area in which it is welded to the glass, compared to the area in which the discharge arc is fixed, is smaller and that the diameter of the electrode rod proceeding from the area in which the discharge arc is held is incrementally or continuously reduced in size in the direction to the weld with the glass.

This arrangement is intended to achieve the two above described objects both qualitatively. In the discharge lamp disclosed in this patent disclosure document, the internal pressure of at least 0.1 MPa is a very low (1st paragraph in the description in the application documents). Therefore, for a discharge lamp with a high internal pressure, for example, of at least 15 MPa, i.e., with an internal pressure which is two orders of magnitude greater, as for the discharge lamp of the short arc type in accordance with the invention, the objects could not always be completely achieved.

SUMMARY OF THE INVENTION

The object of the invention is to devise an arrangement with relatively high pressure tightness in a super-high pressure mercury lamp which is operated with an extremely high mercury vapor pressure.

The object is achieved, in accordance with a preferred embodiment of the invention, in a super-high pressure mercury lamp of the short arc type which comprises the following:

- an arc tube portion in which there is a pair of opposed electrodes, with tungsten as the main component, and which is filled with at least 0.15 mg/mm$^3$ mercury and
- side tube portions which extend from opposite sides of the arc tube portion and in which the electrodes are partially hermetically sealed, and in which the electrodes and metal foils are welded to one another, in that the above described electrodes and the above described metal foils are each electrically connected to one another by means of a metallic component as an individual body with a smaller cross sectional area than the cross sectional area of the above described electrodes.

The object is furthermore achieved in a super-high pressure mercury lamp of the short arc type in that the above described metallic component has a diameter from 0.1 mm to 0.5 mm.

The object is also achieved in a super-high pressure mercury lamp of the short arc type in that an extremely small space is formed in the above described side tube portions between the side and the end face of the above described respective electrode and the silica glass comprising these side tube portions.

Still further, the object is achieved in a super-high pressure mercury lamp of the short arc type which comprises an arc tube portion in which there is a pair of opposed electrodes, with tungsten as the main component, and which is filled at least 0.15 mg/mm$^3$ mercury and side tube portions which extend to opposite sides of the arc tube portion and in which there are metal foils, in that in the area opposite the above described respective side tube portion, the respective above described electrode with the material which comprises this side tube portion forms an extremely small gap and that the above described respective electrode is made of a part with a larger diameter which is opposite this material component, and of a part with a smaller diameter which is welded to the above described metal foil.

The object is furthermore achieved in a high pressure mercury lamp of the short arc type in that the part with a larger diameter of the electrode has a diameter from 0.6 mm to 1.5 mm and that the part with a smaller diameter of the electrode has a diameter from 0.1 mm to 0.5 mm.

The invention is explained in greater detail below using several embodiments shown in the drawings.

DETAILED DESCRIPTION OF THE INVENTION

Figure 1:
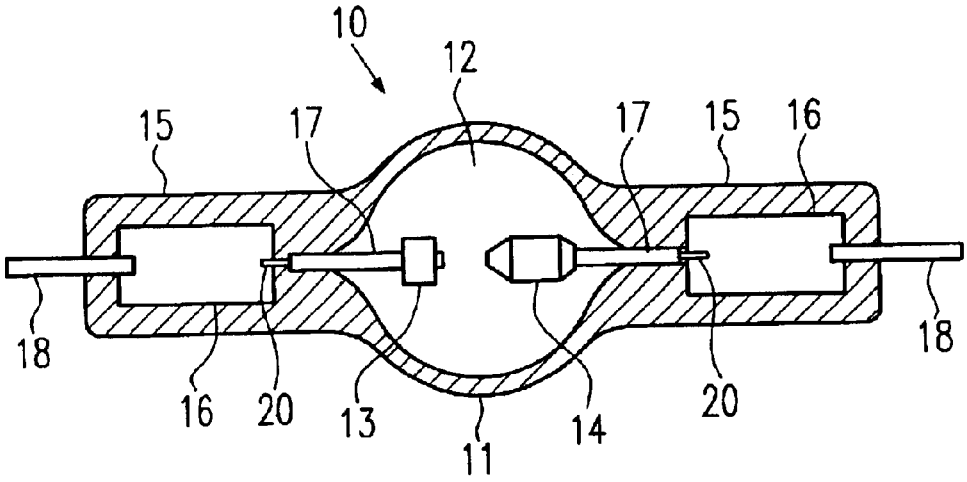
FIG. 1 is an overall cross-sectional view of the first embodiment of a super-high pressure discharge lamp of the short arc type in accordance with the invention.

In the super-high pressure discharge lamp of the short arc type according to a first aspect of the invention, a connecting point to the metal foil is formed using a metallic component with a smaller diameter. Therefore, formation and growth of cracks at this connecting point can be advantageously suppressed. It has been found that, with welding to the metal foil in the side tube portion, crack formation at this connecting point can be suppressed by placing a metallic component, as an individual body, between the electrode rod and the metal foil and by reducing the outside diameter of this metal component to 0.1 mm to 0.5 mm, instead of welding the electrode rod and the metal foil to one another, as is conventional.

The super-high pressure discharge lamp of the short arc type as in accordance with the invention is subject to extremely strict thermal conditions, the internal air pressure during operation being 15 MPa, the internal volume of the arc tube being roughly 80 mm$^3$ and the value of the wall load being at least 0.8 W/mm$^2$. By the arrangement that the electrodes extend from the discharge space to the side tube portions with an essentially identical size, however, the action of heat transfer from the electrode rod takes effect to a sufficient degree and the high temperature within the discharge space is advantageously subjected to heat dissipation from the side tube portions.

This means that the electrode rods extend, for the heat dissipation effect, unchanged in the thick state as far as to the side tube portions, and only when there is a connection to the metal foils is each metallic component used as an individual body in order to prevent formation of gaps. The electrode rods discharge the high temperature of the discharge space as conduction heat as far as the side tubes, and in these side tube portions, it is subjected to heat dissipation from the outside peripheral surfaces of the electrode rods via the silica glass.

In the super-high pressure discharge lamp of the short arc type according to another aspect of the invention, the electrodes as parts with a larger diameter extend in the areas which are opposite the side tube portions. In this way, these electrodes (electrode rods) discharge the high temperature of the discharge space as conduction heat as far as the side tubes, and in these side tube portions, it can be advantageously subjected to heat dissipation from the outer peripheral surfaces of the electrode rods via the material components of the side tube portions, for example, via the silica glass.

At the welds, with the metal foils on the electrode tips, the electrodes have a smaller diameter. Therefore, the inevitable gaps which arise when the electrodes are welded to the metal foils become smaller, and in this way, increase the pressure tightness in the side tube portions. The numerical values are shown below.

The part with the larger diameter has a diameter from 0.6 to 1.5 mm.

The part with the smaller diameter has a diameter from 0.1 to 0.5 mm.

In the areas in which the electrodes (electrode rods) are opposite the side tube portions, between the electrode surfaces and the material comprising the side tube portions, there are extremely small gaps. In this way, in a process in which, after high temperature heating of these side tube portions in the process of hermetic sealing, the temperature gradually drops, the relative difference between the amount of expansion as a result of the difference between the coefficient of thermal expansion of the material comprising the electrodes and the coefficient of thermal expansion of the material comprising the side tube portions can be prevented. As a result, crack formation at the contact points caused thereby can be advantageously suppressed.

FIG. 1 shows the overall arrangement of a first embodiment of the super-high pressure discharge lamp of the short arc type of the invention (hereinafter also called only a "discharge lamp"). In the figure, a discharge lamp 10 has an essentially spherical discharge space 12 which is formed by a silica glass discharge vessel 11. In this discharge space 12, a cathode 13 is disposed opposite an anode 14 supported on an end of a respective electrode rod 17. Furthermore, from the two ends of the discharge space 12, there extend hermetically sealed portions 15 in which metal foils 16, which normally are made of molybdenum, are hermetically installed, for example, by a pinch seal. The base parts of the electrode rods 17 are each located on an end of the metal foil 16, welded and electrically connected, while a respective outer lead pin 18, which extends outward from the sealed portion 15, is welded on the other end of the metal foil 16. The term "electrodes" is defined as the cathode 13, the anode 14 and the electrode rods 17. The main component of which the electrodes are formed is tungsten.

On one end of the respective electrode rod 17, on the side of the metal foil 16, there is a metallic component 20 which is an individual body which is different from the electrode rod 17. This metallic component 20 is made of molybdenum or a material with molybdenum as the main component, as is described below. The cross sectional area of the metallic component 20 is smaller than the cross sectional area of the electrode rod 17. Furthermore, the metallic component 20 acts as a bridge between the electrode rod 17 and the metal foil 16 in the sense of a feed function, by which the two are electrically connected to one another. By using a material for the metallic component 20 with a better heat conduction property than the material comprising the electrodes, is it possible to improve the adhesive property in the production process for the hermetically sealed portions.

The discharge space 12 is filled with mercury, a rare gas, and halogen gas. The mercury is used to obtain the necessary wavelengths of visible light, for example, to obtain radiant light with wavelengths from 360 nm to 780 nm, and is contained in an amount of at least 0.15 mg/mm$^3$. The internal pressure, of course, differs depending on the temperature condition. However, an extremely high vapor pressure is achieved at a pressure during operation of at least 15 MPa.

By adding a larger amount of mercury (for example, 0.20 mg/mm$^3$, 0.25 mg/mm$^3$, 0.30 mg/mm$^3$), a discharge lamp with a high mercury vapor pressure during operation of at least 20 MPa or 30 MPa can be produced. The higher the mercury vapor pressure becomes, the more suitable a light source for a projector device can be implemented.

For the rare gas, for example, roughly 13 kPa argon gas is added. The rare gas is used to improve the operating starting property.

As the halogen, bromine, chorine, iodine or the like in the form of a compound with mercury or other metals is added. The amount of halogen added can be chosen, for example, from the range of $10^{-6}$ $\mu$mole/mm$^3$ to $10^{-2}$ $\mu$mole/mm$^3$. Its function is to prolong the service life by preventing milky opacification of the discharge vessel or for similar purposes. In an extremely small discharge vessel with a high internal pressure, as in the discharge lamp of the invention, this addition of a halogen affects the phenomenon of preventing damage and devitrification of the discharge vessel.

The wall load of the discharge lamp is at least 0.8 W/mm$^2$. The reason for this is that the discharge vessel contains a large amount of mercury so that the thermal condition for vaporization of this mercury is adequately met during lamp operation.

The internal volume of the discharge lamp is small, i.e., at most 80 mm$^3$. The reason for this is that there is a demand for reducing the size of the discharge lamp as much as possible according to the reduction in size of the liquid crystal projector device.

The numerical values of one such discharge lamp are described by way of example below.

For example:

the maximum outside diameter of the arc tube portion is 9.5 mm;

the distance between the electrodes is 1.5 mm;

the internal volume of the arc tube is 75 mm$^3$;

the wall load is 1.5 W/mm$^2$;

the rated voltage is 80 V; and the rated wattage (power) is 150 W.

This discharge lamp is installed in the above described projector device and in a display device such as an overhead projector or the like and can emit radiant light with good color reproduction.

FIGS. 2(*a*) to 2(*g*) each show the base point of the anode in an enlarged representation, in which, between the electrode and the metal foil of the discharge lamp, there is a bridge in accordance with the first embodiment of the invention. FIGS. 2(*a*) to 2(*g*) show specific versions as examples. Starting with FIG. 2(*b*), the silica glass is not shown, but is provided as represented in FIG. 2(*a*).

In FIG. 2(*a*), on one end of the electrode rod 17, there is a metallic component 20*a*, as the individual body, which is formed of a metallic wire. One end of the wire is wound a few times around an end of the electrode rod and its other end is welded to the metal foil.

In FIG. 2(*b*), the metallic component 20*b* is not a wire, but rather is formed of a bent rod-shaped component. One end of this metallic component 20*b* is spot-welded to one end of the electrode rod. Likewise, the other end of the metallic component 20*b* is spot-welded to the metal foil.

In FIG. 2(*c*), the metallic component 20*c* is a straight, rod-shaped component. One end of the metallic component 20*c* is inserted into an opening which is located in the center of an end of the electrode rod and attached. The other end of the metallic component 20*c* is welded to the metal foil 16.

In FIG. 2(*d*), the metallic component 20*d* is formed of a conductive wire, and the electrode rod 17 is provided with a through opening 170 through which the conductive wire passes. The two ends of the conductive wire are each welded to the metal foil 16. This arrangement has the advantage that the metallic component 20*d* can be formed with a cross sectional area which is only half as large as the cross sectional area of the metallic components which are shown above in FIGS. 2 (*a*) to (*c*) and that the same overall cross sectional area is obtained by the arrangement of two metallic leads.

In FIG. 2(*e*), the metallic component 20*e* comprises a conductive spring part (coil part) 20$e_1$ and a rod-shaped, conductive component 20$e_2$. The conductive spring part 20$e_1$ has a first portion that is wound around the electrode rod and a second portion which is wound around the rod-shaped, conductive component 20$e_2$. This arrangement is held by means of the spring force of the conductive springs 20$e_1$ on the electrode rod 17. Furthermore, the conductive component 20$e_2$ is held by the spring force. The other end of the conductive component 20$e_2$ is welded to the metal foil 16.

In FIG. 2(*f*), the metallic component 20*f* is a straight, rod-shaped component. One end of the metallic component 20*f* is welded to a flat area formed on the electrode rod by cutting it off. The other end of the metallic component 20*f* is welded to metal foil 16.

In FIG. 2(*g*), the metallic component 20*g* is a straight, rod-shaped component which is welded to the electrode rod 17.

The electrode rod 17 has a diameter from 0.6 mm to 1.5 mm. The metallic component 20 has a diameter from 0.1 mm to 0.5 mm. Specific numerical values are described by way of example below:

The anode 14 has a diameter of 1.8 mm and a length of 3.34 mm.

The apex angle of the conical tip area of the anode 14 is 70°.

The electrode rod 17 has a diameter of 1.0 mm and a length of 3.5 mm.

The metallic component 20 has a diameter of 0.14 mm and a length of 1.8 mm.

FIGS. 2(*a*) to 2(*g*) show arrangements in which the electrode rod 17 is shorter than the anode 14. The electrode rod 17 is however in reality somewhat longer. It is furthermore necessary for the side tube portion to be formed from silica glass in the external vicinity of the electrode rod 17. The reason for this is that heat dissipation from the outer peripheral surface of the electrode rod via the silica glass becomes important.

Figure 3:
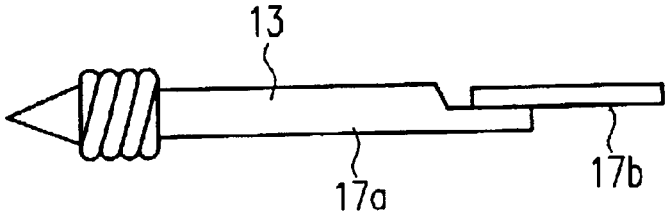
FIG. 3 is a partial side view of the first embodiment of a super-high pressure discharge lamp of the short arc type according to the invention in the area in which an electrode is connected to a foil.

FIG. 3 shows an enlarged representation of the base point of the cathode of the super-high pressure discharge lamp of the first embodiment of the invention. Here, in contrast to FIG. 2, the metal foil is not shown. A metallic component 17*b* with a smaller outside diameter than the outside diameter of the electrode rod is connected to an end of the electrode rod 17*a* of the cathode 13. The other end of the metallic component 17*b* is connected to a metal foil which is not shown in the drawings. The metallic component 17*b* can be of any of the arrangements shown in FIGS. 2(*a*) to 2(*g*). In this embodiment, however, the arrangement shown in FIG. 2(*f*) is shown by way of example. The numerical values are described below by way of example:

The electrode rod 17*a* has a diameter from 0.6 mm to 1.5 mm.

The metallic component 17*b* has a diameter from 0.1 mm to 0.5 mm.

In the cathode, in contrast to the anode, the electrode and the electrode rod are not distinguished from one another, so that the two as a whole are called "electrode." However, the electrode can be distinguished from the electrode rod and can also be called the electrode rod separately. Furthermore, the cathode can also have an arrangement in which the tip is provided with an electrode head with a larger diameter, as in the anode.

The coil wound around the cathode tip is used to improve the operating starting property.

The arrangement of the cathode is shown specifically below.

In the cathode, the diameter of the electrode rod 17*a* is 0.8 mm, the length (the distance from the tip) is 8.0 mm, the diameter of the metallic component 17*b* is 0.14 mm and its length is 1.8 mm.

Figure 4:
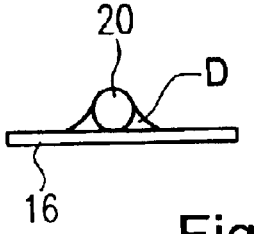
FIG. 4 shows an end view of the portion of the first embodiment of a super-high pressure discharge lamp of the short arc type according to the invention in the area in which an electrode is connected to a foil.
Figure 2A:
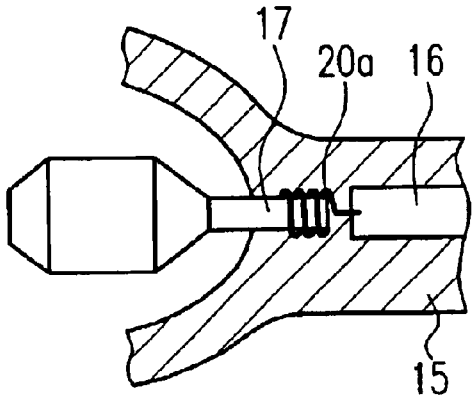
FIGS. 2(*a*)–2(*g*) each show a portion of the first embodiment of a super-high pressure discharge lamp of the short arc type of the invention in the area in which an electrode is connected to a foil.
Figure 2B:
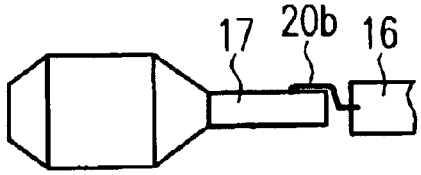
Figure 2C:
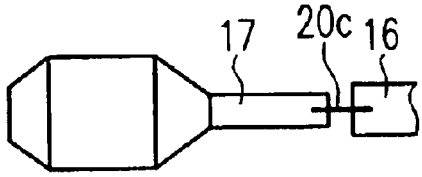
Figure 2D:
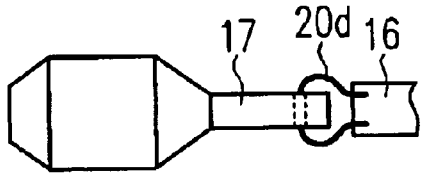
Figure 2E:
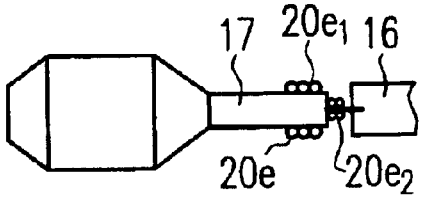
Figure 2F:
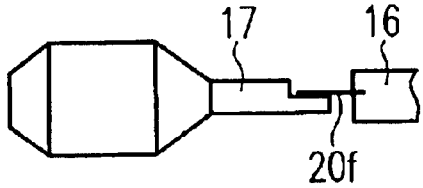
Figure 2G:
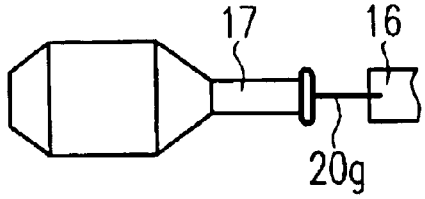

FIG. 4 shows the point at which the metallic component 20 is connected to the metal foil 16 in an enlarged representation. At one such connecting point, a gap D is inevitably formed. If a high gas pressure within the discharge space is applied to this gap D, cracks are caused to form and grow. The inventors have ascertained that such a gap D is greatly influenced by the outside diameter of the metallic component 20. This means that the gap D does not become larger than the cross sectional area of the metallic component. That the metallic component 20 is small, of course, means that the gap D is also small.

Figure 5:
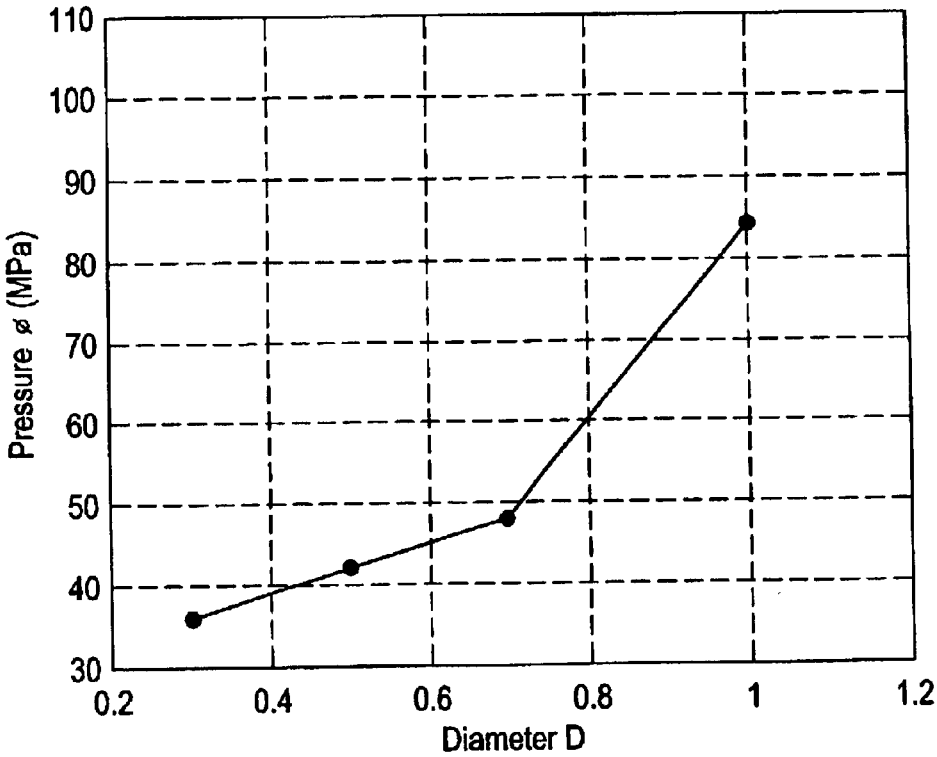
FIG. 5 a graph representing the action of the first embodiment of a super-high pressure discharge lamp of the short arc type in accordance with the invention.

FIG. 5 shows the measurement of the relation between the outside diameter of the metallic component 20 and the pressure applied to this gap D in the case of changing only the outside diameter of the metallic component 20 in a discharge lamp, as was shown, by way of example, in the above described embodiment. In the drawings, the y-axis plots the pressure of the gas applied to the gap and the x-axis plots the outside diameter of the metallic component. The connecting point between the metallic component 20 and the metal foil has the arrangement shown in FIG. 2(*f*). The discharge lamp has the arrangement described in conjunction with FIG. 1. The amount of mercury added is 0.15 $mg/mm^2$.

It is apparent from FIG. 5 that, in the case of an outside diameter of the metallic component of 1.0 mm, the applied pressure is 80 MPa, in the case of an outside diameter of the metallic component of 0.7 mm, the applied pressure is roughly 48 MPa, in the case of an outside diameter of the metallic component of 0.5 mm, the applied pressure is roughly 42 MPa, and in the case of an outside diameter of the metallic component of 0.3 mm, the applied pressure is roughly 36 MPa. Since the electrode rod has a diameter of 1.0 mm, this diameter is identical to the outside diameter of the metallic component of 1.0 mm. This means that the arrangement of the connection of the invention by means of the metallic component as an individual body is not present.

As is apparent from the result shown in FIG. 5, the arrangement of the metallic component with diameter smaller than the diameter of the electrode rod greatly reduces the pressure applied to this gap. It is demonstrated that especially at an outside diameter of the metallic components of at most 0.5 mm, this pressure is extremely reduced.

Since the metallic component 20 is normally formed with a circular cross section, in the above described tests, the measurements were taken such that the value of the outside diameter of the metallic component is regarded as a criterion. However, it goes without saying that essentially the cross-sectional area of the metallic component influences the size of the gap which forms during the connection.

Figure 6:
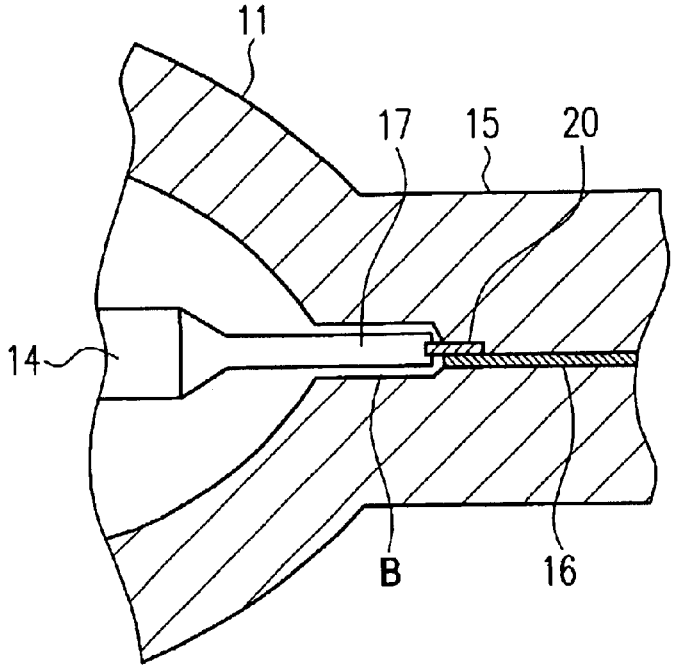
FIG. 6 is a partial sectional view of another version of the first embodiment of a super-high pressure discharge lamp of the short arc type in accordance with the invention.

FIG. 6 shows another embodiment of the high pressure discharge lamp of the short arc type in accordance with the invention. Here, the base point of the anode is shown enlarged. This arrangement has the feature that the outside surface of the electrode rod 17 is surrounded by a gap B. The reason for the arrangement of this gap is to advantageously prevent formation of cracks between the electrode rod and the silica glass in a discharge lamp which is filled with an extremely high mercury vapor pressure of 0.15 $mg/mm^3$.

Since the size of the gap is, for example, roughly 3 μm (microns) to 10 μm (microns), the action of heat dissipation from the surface of the electrode rod is adequately maintained.

Here, the arrangement is the same as in the above described embodiment, except that there is a gap B. The metallic component 20 acts as a bridge between the electrode rod 17 and the metal foil 16. The arrangement of the gap in itself is described in Japanese patent application 2000-168798 (corresponding to commonly-owned, co-pending published U.S. application Ser. No. 20020031975 A1).

The numerical values of the discharge lamp of the short arc type as claimed in the invention are described by way of example below:

outside diameter of the side tube portion: 6.0 mm total length of the lamp: 65.0 mm length of the side tube: 25.0 mm inside volume of the arc tube: 0.08 $cm^3$ distance between the electrodes: 2.0 mm rated luminous wattage (power): 200 W rated luminous current: 2.5 A amount of mercury added: 0.15 $mg/mm^3$ rare gas: 13 kPa argon As was described above, the super-high pressure mercury lamps of the short arc type of the invention have an extremely high internal pressure during operation of greater than 15 MPa and are also subject to extremely strict thermal conditions. However, since in the connection of the electrode rod to the metal foil, between the two, the metallic component is located as a bridge, the following is achieved:

1. At an extremely high gas pressure within the discharge vessel during operation crack formation in the hermetically sealed portions can also be advantageously prevented.
2. In spite of the extremely strict thermal conditions during operation, the high temperature formed in the discharge space can advantageously be subjected to heat dissipation via heat transfer of the electrode rods.

A second embodiment of the super-high pressure discharge lamp of the short arc type as claimed in the invention is described below.

Figure 7:
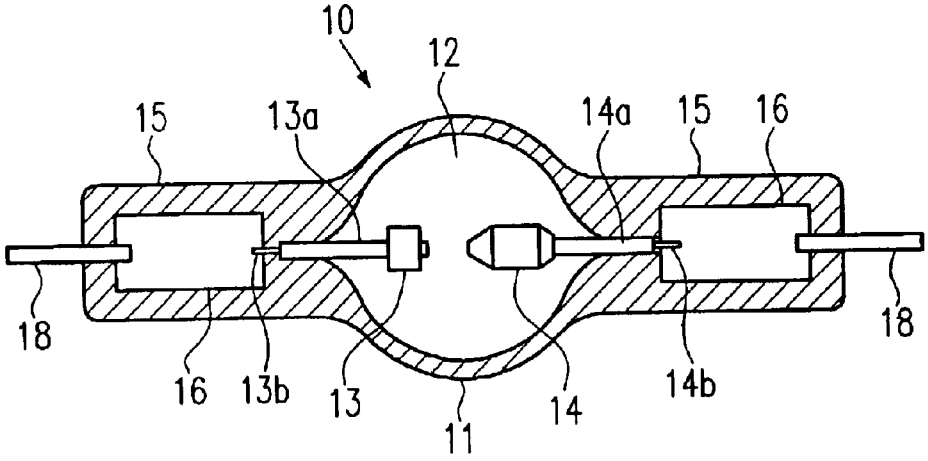
FIG. 7 is an overall cross-sectional view of a second embodiment of a super-high pressure discharge lamp of the short arc type of the invention.

FIG. 7 is a schematic of the overall arrangement of the second embodiment of the super-high pressure discharge lamp of the short arc type as claimed in the invention. In the figure, the same parts as in FIG. 1 are provided with the same reference numbers as in FIG. 1. As is described below, between the cathode 13 and the side tube portion 15 and between the anode 14 and the side tube portion 15 extremely small gaps are formed. However, in FIG. 7, these gaps are not shown with respect to the representation of the overall arrangement of the lamp.

Figure 8A:
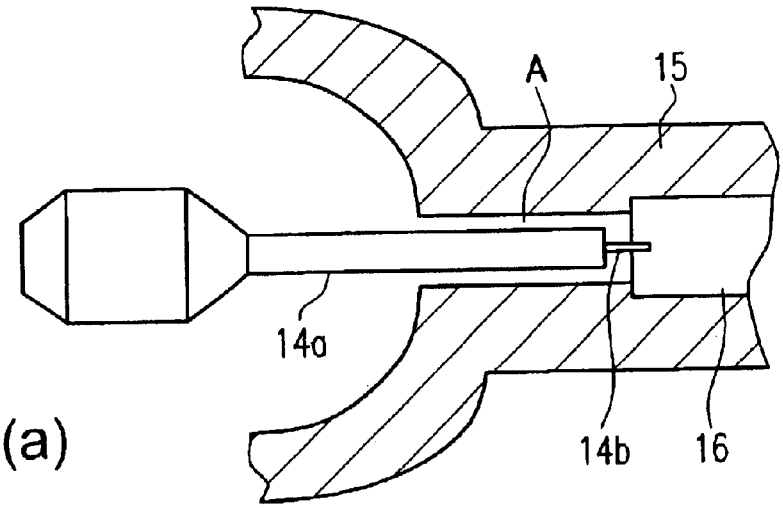
FIGS. 8(*a*) & 8(*b*) each show an enlarged representation of the anode of a second embodiment of the super-high pressure discharge lamp of the short arc type in accordance with the invention.
Figure 8B:
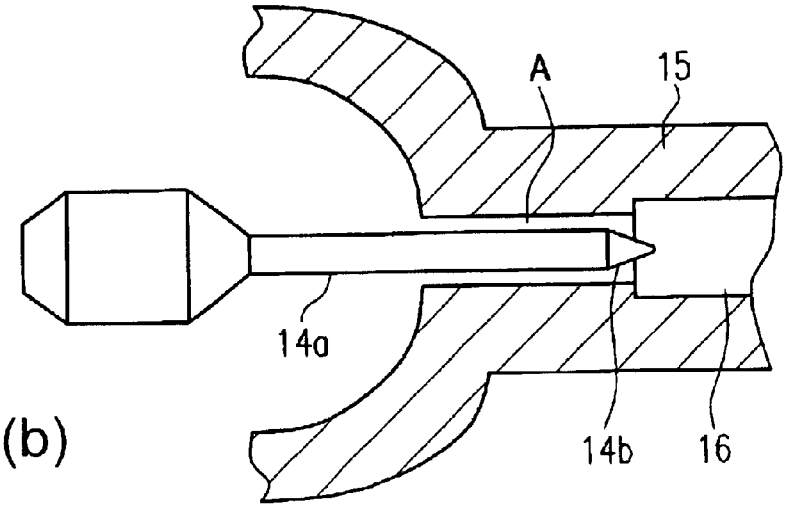

FIGS. 8(*a*) and 8(*b*) each are an enlarged representation of the anode of the second embodiment of the discharge lamp of the invention. The electrode 14 comprises a part 14*a* which is located in the discharge space with a larger diameter and of a part 14*b* which is located on the side of the metal foil with a smaller diameter. The parts 14*a*, 14*b* were formed by working from a single part. In the part 14*b* with a smaller diameter, a connection is made to the metal foil 16. Between the surface of part 14*a* with a larger diameter and the inner surface of the silica glass side tube portion 15, an extremely small gap A is formed. In FIG. 8(*a*), in the electrode 14, the part 14*a* with the larger diameter and the part 14*b* with a smaller diameter are formed step-shaped. In FIG. 8(*b*), the part 14*b* with the smaller diameter is located bordering the part 14*a* with the larger diameter, the part 14*b* having a tapering diameter which becomes increasingly smaller. The numerical values are described below by way of example.

The diameter of the part 14*a* with the larger diameter is 0.6 mm to 1.5 mm.

The diameter of the part 14*b* with a smaller diameter is 0.1 to 0.5 mm.

Since the part with the larger diameter of the electrode rod extends in the above described manner along the inside surface of the side tube portion, this electrode rod discharges the high temperature of the discharge space as conduction heat to the side tube portion and it can advantageously be subjected to heat dissipation proceeding from the outside peripheral surface of the electrode rod via the material component of the side tube portion, for example, via the silica glass.

Since the part with the smaller diameter of the electrode rod is welded to the metal foil, the gap which inevitably forms when the electrode is welded to the metal foil can be made smaller, and in this way, the pressure tightness in the side tube portion can be increased.

Figure 9:
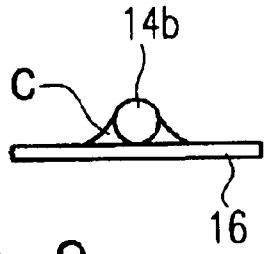
FIG. 9 shows an enlarged representation of the weld of the metal foil of the second embodiment of the super-high pressure discharge lamp of the short arc type according to the invention.

FIG. 9 shows the gap C which inevitably forms when the metal foil 16 is joined to the electrode rod 14*b*. As is apparent from FIG. 9, the gap C is made smaller when the outside diameter of the electrode rod is small.

Figure 10A:
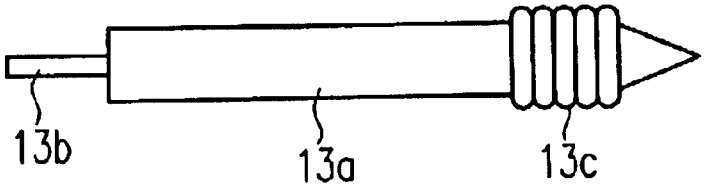
FIGS. 10(*a*) & 10(*b*) each show an enlarged representation of the cathode of the second embodiment of the super-high pressure discharge lamp of the short arc type in accordance with the invention.
Figure 10B:
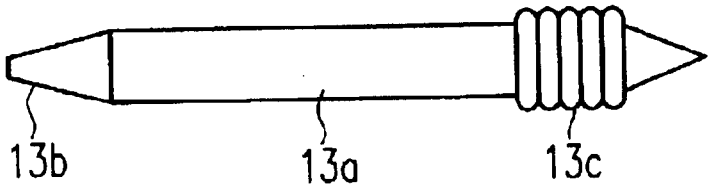

FIGS. 10(*a*) and 10(*b*) each show an enlarged representation of the cathode of the super-high pressure discharge lamp of the invention. Here, in contrast to FIGS. 8(*a*) and 8(*b*), the metal foil and the quartz glass are not shown. The cathode 13 also has a part 13*a* with a larger diameter and a part 13*b* with a smaller diameter. The part 13*a* with the larger diameter extends from the emission space to the side tube portion. Therefore, the high temperature in the arc tube portion can be discharged as conduction heat out of the side tube portion by heat dissipation. In the part 13*b* with the smaller diameter, a connection is made to the metal foil. As in the anode, the inevitable gap which forms during connection can be made smaller. In the cathode, in contrast to the anode, the electrode and the electrode rod are not distinguished from one another, and as a whole, the two are called an electrode. However, the electrode rod can also be regarded as a separate part, or the electrode head with a larger diameter can be placed at the tip, as in the anode. A coil 13*c* which is wound around the cathode tip is used to improve the operating-starting property.

In FIGS. 8(*a*) and 8(*b*), the super-high pressure mercury lamp in the second embodiment of the invention has an extremely small gap A between the electrode rod and the inside surface of the side tube portion. Therefore, this gap A is provided so that the electrode, as a result of the differences between the coefficient of expansion of the material component of the electrode and the material comprising the side tube portion, is not confined, but it can expand freely in the axial direction. In the case in which the electrode is made of tungsten and the side tube portion of silica glass, the width of the gap A is chosen from the range of 6 μm (microns) to 16 μm (microns); in the lengthwise direction of the electrode, there is a gap A of a length from 3 mm to 5 mm.

By forming such a gap A, the formation of cracks by the relative motion of the electrode and silica glass relative to one another can be advantageously prevented. In FIGS. 8(*a*) and 8(*b*), the gap A is shown exaggerated.

With respect to the action of the invention, it is desirable to provide the gap A at both electrodes, i.e., both in the cathode and also in the anode. However, this does not preclude there being a gap only at one of the electrodes.

Finally, the numerical values of the discharge lamp of the short arc type of the invention are suitably:

outside diameter of the side tube portion: 6.0 mm total length of the lamp: 65.0 mm length of the side tube: 25.0 mm inside volume of the arc tube: 0.08 $cm^3$ distance between the electrodes: 2.0 mm rated luminous wattage (power): 200 W rated luminous current: 2.5 A amount of mercury added: 0.15 mg/mm$^3$ rare gas: 13 kPa argon As was described above, in the super-high pressure mercury lamps of the short arc type, according to a second aspect of the invention, the electrodes have a part with a smaller diameter and a part with a larger diameter, and the part with the larger diameter extends in the area opposite the side tube portion. Therefore, the high temperature of the discharge space can be discharged as conduction heat as far as the side tubes and advantageously subjected to heat dissipation in these side tube portions from the outside peripheral surfaces of the electrode rods via the material component of the side tube portions, for example, via the silica glass.

The electrodes have a smaller diameter at the welds to the metal foils on the electrode tips. Therefore, the inevitable gaps which form when the electrodes are welded to the metal foil can be made smaller, and thus, the pressure tightness in the side tube portions can be increased.

In the area in which the electrode (electrode rod) runs opposite the side tube portion, between the electrode surface and the material comprising the side tube portion, an extremely small gap is formed. In this way, in the process in which after high temperature heating of these side tube portions in the process of hermetic sealing, the temperature thereof gradually drops, the relative difference between the amount of expansion as a result of the difference between the coefficient of thermal expansion of the material comprising the electrodes and the coefficient of thermal expansion of the material comprising the side tube portions can be prevented. As a result, crack formation at the contact points caused thereby can be advantageously suppressed.

What we claim is:

1. Super-high pressure discharge lamp of the short arc type which comprises:

an arc tube portion which is filled with at least 0.15 mg/mm$^3$ mercury;

a pair of opposed electrodes disposed in the arc tube portion;

side tube portions which extend from opposite sides of the arc tube portion; and a metal foil located in each of said side tube portions, wherein each of the electrodes is electrically connected to a respective metal foils by at least one metallic component, the at least one metallic component having a cross-sectional area which is smaller than that of the electrodes in an area in which the electrodes are located in the side tube portions.

2. Super-high pressure discharge lamp of the short arc type as claimed in claim 1, wherein the at least one metallic component is separate from the respective electrode and the metal foil.

3. Super-high pressure discharge lamp of the short arc type as claimed in claim 1, wherein the at least one metallic component is part of the respective electrode.

4. Super-high pressure discharge lamp of the short arc type as claimed in claim 1, wherein the main component of the electrodes comprises tungsten.

5. Super-high pressure discharge lamp of the short arc type as claimed in claim 2, wherein the at least one metallic component is essentially rod-shaped.

6. Super-high pressure discharge lamp of the short arc type as claimed in claim 3, wherein the metallic component is essentially rod-shaped.

7. Super-high pressure discharge lamp of the short arc type as claimed in claim 5, wherein the at least one metallic component projects in an axial direction over an end of the electrode located in the side tube portion.

8. Super-high pressure discharge lamp of the short arc type as claimed in claim 6, wherein the at least one metallic component projects in an axial direction over an end of the electrode located in the side tube portion.

9. Super-high pressure discharge lamp of the short arc type as claimed in claim 2, wherein the at least one metallic component is essentially wire-shaped.

10. Super-high pressure discharge lamp of the short arc type as claimed in claim 9, wherein the at least one metallic component is routed through a through-hole in an end of the electrode located in one of the side tubes and ends of the at least one metallic component are bent in a direction to the metal foil.

11. Super-high pressure discharge lamp of the short arc type as claimed in claim 9, wherein the metallic component is wound helically around an end of the electrode located in one of the side tubes.

12. Super-high pressure discharge lamp of the short arc type as claimed in claim 2, wherein the metallic component is welded to an end of the electrode located in one of the side tubes.

13. Super-high pressure discharge lamp of the short arc type as claimed in claim 1, wherein the at least one metallic component has a diameter from 0.1 mm to 0.5 mm.

14. Super-high pressure discharge lamp of the short arc type as claimed in claim 13, wherein the electrodes have a diameter from 0.6 to 1.5 mm in an area in which they are located in the side tube parts.

15. Super-high pressure discharge lamp of the short arc type as claimed in claim 2, wherein the arc tube portion and the side tube portions are made of silica glass, and wherein there is a very small intermediate space between the silica glass of the side tube portions and the electrodes.

16. Super-high pressure discharge lamp of the short arc type as claimed in claim 3, wherein the arc tube portion and the side tube portions are made of silica glass, and wherein there is a very small intermediate space between the silica glass of the side tube portions and the electrodes.

17. Super-high pressure discharge lamp of the short arc type which comprises:

an arc tube portion which is filled with at least 0.15 mg/mm$^3$ mercury;

a pair of opposed electrodes disposed in the arc tube portion;

side tube portions which extend from opposite sides of the arc tube portion; and a metal foil located in each of said side tube portions, wherein each of the electrodes has a part with a larger diameter which is at least partially located in a respective one of the side tube portions, and a part with a smaller diameter which is welded to a respective one of the metal foils, and wherein a small intermediate space is provided between the part of the electrode with the larger diameter and the side tube portion.

18. Super-high pressure discharge lamp of the short arc type as claimed in claim 17, wherein a main component of which the electrodes are made is tungsten.

19. Super-high pressure discharge lamp of the short arc type as claimed in claim 17, wherein the part of the electrode with a larger diameter has a diameter of from 0.6 mm to 1.5 mm and the part of the electrode with the smaller diameter has a diameter of from 0.1 mm to 0.5 mm.

* * * * *